United States Patent [19]

Richter

[11] 4,174,997

[45] Nov. 20, 1979

[54] METHOD AND APPARATUS FOR CONTINUOUS HYDROLYSIS OF CELLULOSIC FIBER MATERIAL

[75] Inventor: Johan C. F. C. Richter, St. Jean Cap Ferrat, France

[73] Assignee: Kamyr Aktiebolag, Karlstad, Sweden

[21] Appl. No.: 500,900

[22] Filed: Aug. 26, 1974

[30] Foreign Application Priority Data

Sep. 3, 1973 [SE] Sweden ..... 11940

[51] Int. Cl.[2] ..... D21C 1/02; D21C 1/04; D21C 3/02; D21C 3/24

[52] U.S. Cl. ..... 162/19; 162/52; 162/60; 162/76; 162/237; 162/246

[58] Field of Search ..... 162/19, 237, 52, 246, 162/60, 49, 76

[56] References Cited

U.S. PATENT DOCUMENTS

| | | | |
|---|---|---|---|
| 2,858,211 | 10/1958 | Durant et al. | 162/237 |
| 3,380,883 | 4/1968 | Richter et al. | 162/237 X |
| 3,413,189 | 11/1968 | Backlund | 162/19 |
| 3,429,773 | 2/1969 | Richter | 162/237 |
| 3,814,664 | 6/1974 | Carlsmith | 162/246 X |

*Primary Examiner*—S. Leon Bashore
*Assistant Examiner*—Steve Alvo
*Attorney, Agent, or Firm*—Cushman, Darby & Cushman

[57] ABSTRACT

A method and apparatus for continuously hydrolizing finely comminuted cellulosic fiber material and separately extracting the acid hydrolysate therefrom. Cellulosic material is fed into an upright elongated reaction vessel near the upper or top portion thereof and heated to hydrolysis temperature. The heated fiber material then passes downward through the reaction vessel and is concurrently treated by exposure to a short liquid phase which comprises concurrent impregnation and simultaneous concurrent hydrolysis to partially hydrolize the fiber material. The material is then exposed counter-currently to a liquid phase comprising a counter-current wash with simultaneous hydrolysis of a wash liquid which has been introduced from the bottom or lower portion of the reaction vessel, the wash liquid having been preheated to full hydrolysis temperature. The hydrolysate is then extracted and removed from the fiber material and the fiber material (free of hydrolysate) is discharged from the lower portion of the reaction vessel.

8 Claims, 1 Drawing Figure

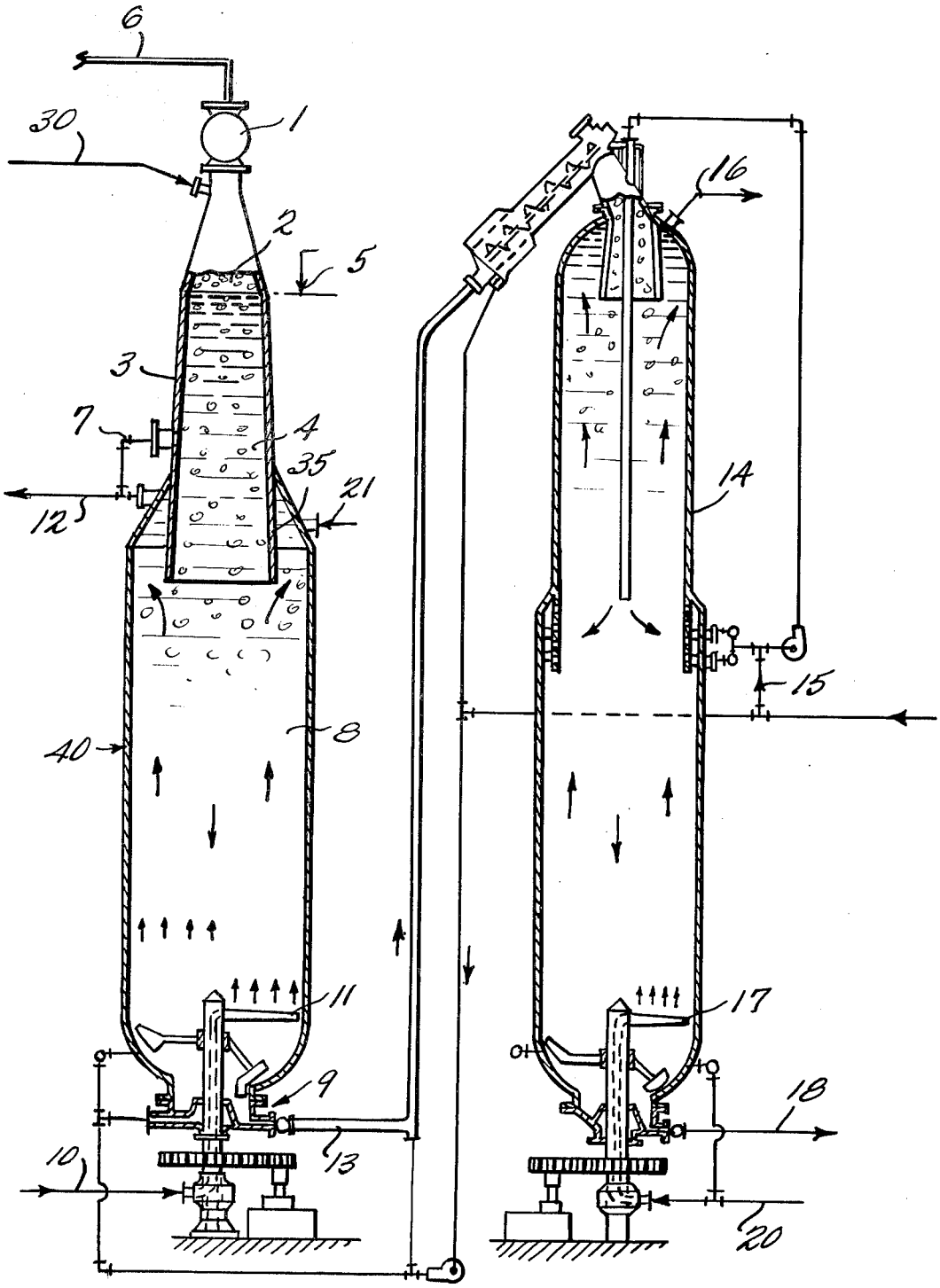
6
1
30
2
5
3
7
4
35
21
12
16
14
15
40
8
11
17
9
18
10
13
20

METHOD AND APPARATUS FOR CONTINUOUS HYDROLYSIS OF CELLULOSIC FIBER MATERIAL

BACKGROUND OF THE INVENTION

This invention relates to a method and an apparatus for hydrolysis treatment of cellulosic fiber material.

Hydrolysis of cellulosic fiber material by means of sulphate cooking has been known for many years. Such processes have been suitable for the manufacture of high-grade dissolved pulp which is useful in the production of rayon, silk and cord. The hydrolysate liquid resulting from such conventional processes, may contain 15–20% of the dry wood substance, for example, pentosans. These dry substances tend to form scalings, so called "gunk" or "carmel," and pluggings both inside as well as outside of the reaction vessel (commonly referred to as the digester).

In discontinuous cooking processes, treatment takes place in the same digester but alternating between acid hydrolysis and then alkaline cooking. In continuous cooking processes, where each step occurs within a certain portion of the digester, the problem of scaling and pluggings within the digester is accentuated. To date, it has been customary to extract both the hydrolysate and the black liquor (formed in conventional digestion processes) together in such continuous processes for common burning.

According to the method and apparatus of the present invention, it is now possible to extract the acid hydrolysate separately from the black liquor, even with continuous cooking. Thus, the process of the present invention enables recovery of up to nearly 100% of the dry hydrolysate substance with fodder yeast being the final product, and at the same time, employing a minimal amount of fuel to carry out the process. Recovery of such fodder yeast product is of great importance considering possible protein shortages which face the world.

The method and apparatus of the present invention will now be described with reference to the drawing.

Cellulosic fiber material, e.g. woodchips, is fed by a conventional means 1, to a steamchamber section 2, located in the top or upper portion 3, of a standing enclosed and elongated circular reaction vessel 40. The top or upper portion of said reaction vessel 40, has a relatively small diameter with a slowly increasing downward cross-section. The fiber material is heated to treatment temperature (about 170° C.) in the downward section by means of steam entering through a pipe 30, at a pressure of about 8–10 atmosphere gage depending upon the partial pressure and evacuated air. The cellulosic fiber material remains in the steam section 2, generally from about 1 to about 5 minutes.

The cellulosic fiber material continues to move downward through the reaction vessel to the next phase wherein the fiber material is impregnated under pressure with liquid. The fiber material is retained in this pressure impregnation zone for generally from a period of about 5–20 minutes. The level of the liquid 5, may be maintained by either adding water through means 6, together with the fiber material, or by addition from a lower portion 7, or a combination of both depending upon process conditions. The level can be controlled by the amount of material extracted. The fiber material moves through the pressure impregnation zone 4, downward through a cylindrical portion 35, which protrudes downward into the lower phase 8, lower phase 8 comprises a counter-current wash and counter-current hydrolysis. The fiber material is treated with the counter-current wash and counter-current hydrolysis generally for period of from about 30–180 minutes. The counter-current section 8 of the vessel has about twice the diameter of the cylindrical vessel in zone 4. The fiber material moves downward to zone 8 by gravity and is fed out by means 9 at the lower portion of the reaction vessel 40.

Wash water preheated to a temperature of about 170° C. is added through a piping 10 generally in an amount of from about 4–5 cubic meters/ton cellulosic fiber material. The wash water is distributed in a conventional manner by means 11, flowing upwards in counter-current relation to the fiber material flowing downward through the vessel. The wash water is removed at 12, as hydrolysate. The hydrolysate contains a dry substance content of from about 2–4% and is collected through a preferably strainerless outlet (12), which is located higher than the lower edge of the concurrent portion 35, which protrudes into the counter-current portion 8, in order to prevent fiber material moving downward through the concurrent portion 35, from flowing out of the vessel. The liquid level in the concurrent section can be regulated by a device for regulating the extracted quantity of hydrolysate through outlet 12. A means for evacuating possible accumulated gases (not shown) should be arranged close to and above the liquid outlet 12.

After passing through the hydrolysis phase, the cellulosic fiber material (now almost completely free from hydrolysate) is transferred through a piping 13, to a sulphate digester 14, by conventional means. The cellulosic fiber material passes from a vessel 40, to the digester 14, while maintaining approximate cooking temperature. It is possible to achieve a decrease in temperature of a few degrees by adding into the transfer piping 13, a small portion of the white liquor which is needed for the cooking phase. By so adding the liquor at this stage, the necessary increase of pH is achieved. Due to such washing of the fiber material, the total comsumption of white liquor is reduced 10–20% compared to prior art methods.

The fiber material is then subjected to sulphate cooking in a conventional manner with the addition of white liquor at 15, and the extraction of black liquor for recovery at 16. The cooking process occurs in a counter-current manner. Wash liquid is added and distributed at 17, and rises upwards in counter-current flow to the fiber material thereby displacing, simultaneously, the white liquor toward the means for extraction 16, for the black liquor upon the completion of cooking. The prewashed pulp is fed out of the digester through the piping 18, for a final washing, e.g. in a continuous diffuser (not illustrated). The filtrate resulting from such final washing may be recycled back as wash liquid at 20.

The level of the cellulosic fiber material in the steam phase section 2 of vessel 40, may be regulated by means of a device (not illustrated) for controlling the removal of the fiber material from the lower portion of the vessel 40. The hydroylsis treatment is controlled and adjusted by regulation of the steam phase temperature wash liquid temperature and wash liquid amounts.

Should it be desirable to facilitate the further handling of the hydrolysate, agents such as lignosulfonic acid may be added through piping means 21, the agent counteracting condensation of the hydrolysis products.

In so much as the method and apparatus embodiments shown and described herein allow the principals of the present invention to be more clearly comprehended and are not intended to limit the scope of the invention as it may be modified while adhereing to said principals, the invention should only be limited by the spirit and scope of the following claims.

What is claimed is:

1. A method for continuously treating cellulosic fiber material containing a dry substance utilizing a first vertical vessel having an upper steam phase and lower liquid phase, and utilizing a second vertical vessel operatively connected to the first vessel said method comprising the steps of (a) feeding cellulosic fiber material into the upper steam phase of the first vessel so that the material is heated to hydrolysis temperature, (b) concurrently impregnating and hydrolizing the material as it moves downwardly in the first vessel in a concurrent liquid phase, (c) subjecting the downwardly moving material to a countercurrent wash liquid heated to hydrolysis temperature, to purge the dry substance therefrom, in a countercurrent liquid phase, (d) extracting and recovering from the first vessel hydrolysate containing the dry substance at a portion of the first vessel generally corresponding to the area between the concurrent and countercurrent liquid phases, (e) discharging the fiber material substantially free of hydrolysate from the first vessel and feeding it to a top portion of the second vessel, (f) digesting the fiber material by subjecting the downflowing fiber material in the second vessel to counter-current digesting liquor flow, (g) extracting and recovering black liquor from the second vessel and maintaining it separate and distinct from the hydrolysate extracted from the first vessel, and (h) removing digested fiber material from the bottom of the second vessel.

2. A method according to claim 1, wherein said fiber material is wood chips and is heated in steps (a) and (c) to about 170° C.

3. A method according to claim 2, wherein the concurrent treatment is continued for a period of from about 5 to about 20 minutes and the counter-current treatment is continued for a period of from about 30 to about 180 minutes.

4. A method according to claim 2, wherein the hydrolysis treatment is controlled and finely adjusted by adjustment of steam phase temperature, wash liquid temperature, and wash liquid quantity.

5. A method as recited in claim 1 comprising the further step of regulating the level of liquid in the concurrent liquid phase of the first vessel by regulating the amount of hydrolysate extracted from the first vessel.

6. A method as recited in claim 1 comprising the further step of adding an agent for counteracting condensation of hydrolysis products to the hydrolosate while extracting hydrolosate from the first vessel.

7. Apparatus for the hydrolysis of fiber material containing a dry substance, comprising a first vertical vessel having an upper steam phase and lower liquid phases, a second vertical vessel, a transfer line connecting the bottom of said first vessel to the top of said second vessel, means for feeding cellulosic fiber material into the upper steam phase of said first vessel so that the material is heated to hydrolysis temperature, means located adjacent the bottom of said first vessel for introducing wash liquid heated to hydrolysis temperature into said first vessel with an upwardly directed velocity component to counter wash and hydrolize the downwardly moving fiber material and purge the dry substance therefrom, means for recovering from said first vessel the hydrolysate, containing the dry substance, at an intermediate portion of said vertical first vessel, means for discharging the fiber material, substantially free of hydrolysate, from the bottom of said first vessel into said transfer line, means for feeding the fiber material from said transfer line into said second vessel, means for subjecting the downflowing fiber material in said second vessel to a countercurrent digesting liquor flow, means for extracting and recovering black liquor from said second vessel and maintainint it separate and distinct from the hydrolysate extracted from said first vessel, and means for removing digested fiber material from the bottom of said second vessel.

8. Apparatus as recited in claim 7 wherein said first vessel includes an upper section having a first diameter extending into a lower section having a second diameter larger than said first diameter, below the top of said lower section, and wherein said means for recovering hydrolysate from said first vessel includes an outlet from the lower section of said first vessel located above the lowermost portion of said upper section of said first vessel so that hydrolysate may be withdrawn from said first vessel without screening.

* * * * *